US007619570B1

(12) United States Patent
Sarehraz et al.

(10) Patent No.: US 7,619,570 B1
(45) Date of Patent: Nov. 17, 2009

(54) DUAL-POLARIZED FEED ANTENNA APPARATUS AND METHOD OF USE

(75) Inventors: Mohammed Sarehraz, Tampa, FL (US); Kenneth A. Buckle, Tampa, FL (US); Elias Stefanakos, Tampa, FL (US); Thomas Weller, Lutz, FL (US); D. Yogi Goswami, Gainesville, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 12/107,122

(22) Filed: Apr. 22, 2008

Related U.S. Application Data

(62) Division of application No. 11/534,781, filed on Sep. 25, 2006, now Pat. No. 7,362,273.

(60) Provisional application No. 60/720,331, filed on Sep. 23, 2005, provisional application No. 60/720,296, filed on Sep. 23, 2005.

(51) Int. Cl.
*H01Q 1/38* (2006.01)

(52) U.S. Cl. ..... 343/700 MS

(58) Field of Classification Search ..... 343/700 MS, 343/702; 455/269, 80–81
See application file for complete search history.

(56) References Cited

U.S. PATENT DOCUMENTS

| | | | | |
|---|---|---|---|---|
| 3,589,177 | A * | 6/1971 | Merlo | 73/114.29 |
| 5,453,755 | A * | 9/1995 | Nakano et al. | 343/872 |
| 5,815,123 | A * | 9/1998 | Uematsu et al. | 343/785 |
| 6,445,355 | B2 * | 9/2002 | Kitamori et al. | 343/771 |
| 6,868,258 | B2 * | 3/2005 | Hayata et al. | 455/81 |
| 7,209,088 | B2 * | 4/2007 | Maruyama et al. | 343/772 |
| 2004/0080455 | A1 | 4/2004 | Lee | |
| 2007/0240757 | A1 * | 10/2007 | Ren et al. | 136/256 |

FOREIGN PATENT DOCUMENTS

JP 2004-32800 * 1/2004

OTHER PUBLICATIONS

Joseph A. Hagerty, Nestor D. Lopez, Branko Popovic, and Zoya Popovic. 2000. "Broadband Rectenna Arrays for Randomly Polarized Incident Waves." Department of Electrical and Computer Engineering, University of Colorado, Boulder, CO.

* cited by examiner

*Primary Examiner*—Huedung Mancuso
(74) *Attorney, Agent, or Firm*—Molly L. Sauter; Smith & Hopen P.A.

(57) ABSTRACT

An antenna apparatus and method for the interception of randomly polarized electromagnetic waves utilizing a dual polarized antenna which is excited through a cross-slot aperture using two well-isolated orthogonal feeds.

4 Claims, 4 Drawing Sheets

DUAL-POLARIZED FEED ANTENNA APPARATUS AND METHOD OF USE

CROSS REFERENCE TO RELATED APPLICATIONS

This application is a divisional of pending U.S. Nonprovisional patent application Ser. No. 11/534,781, entitled, "Dual-Polarized Feed Antenna Apparatus and Method of Use", filed Sep. 25, 2006, which claims priority to U.S. Provisional Patent Application No. 60/720,331, entitled, "A Dual Polarized Feed Structure Applicable to a Single Antenna or an Array", filed Sep. 23, 2005, and pending U.S. Provisional Patent Application No. 60/720,296, entitled, "A High Frequency Feed Structure Applicable to a Single Antenna or an Array", filed Sep. 23, 2005.

STATEMENT OF GOVERNMENT INTEREST

This invention was made with Government support under Grant No. 2106369 LO awarded by the NASA/FSEC. The Government has certain rights in the invention.

BACKGROUND OF THE INVENTION

Light energy is characterized by a dual nature both from a quantum point of view as photons and from a wave point of view as randomly polarized electromagnetic radiation with a wavelength between 400 nm and 700 nm. If the ultraviolet and infrared portion of the spectrum is included, the range of wavelengths is extended at both extremes. Presently, all practical solar cell energy collection schemes utilize the photon nature of light. For example, the conversion of solar energy to electrical energy using the photovoltaic effect depends upon the interaction of photons with energy equal to or greater than the band-gap of the rectifying material. With continued research, the maximum amount of energy captured using the photovoltaic mechanism is estimated to be around 30%.

Optical rectennas are known in the art for harvesting solar energy and converting it into electric power. Optical rectennas consist of an optical antenna to efficiently absorb the incident solar radiation and a high-frequency metal-insulator-metal (MIM) tunneling diode that rectifies the AC field across the antenna, providing DC power to an external load. The combination of a rectifying diode at the feedpoints of a receiving antenna is often referred to as a rectenna. Utilizing a rectenna to harvest solar energy relies upon the electromagnetic nature of radiation and is not limited by the band-gap of the rectifying material. As such, this method is not fundamentally band-gap limited. At microwave frequencies (~2.4 GHz) the rectenna approach has been demonstrated to be approximately 90% efficient. Rather than generating electron-hole pairs as in the photovoltaic method, the electric field from an incident electromagnetic radiation source will induce a wave of accelerated electric charge in a conductor. Efficient collection of the incident radiation is then dependent upon resonance length scales and impedance matching of the collecting antenna to the rectifying diode to minimize losses. However, prior art methods of harvesting high-frequency radiation utilizing rectennas have identified several key problems with the approach. These problems include impedance matching, rectification, polarization, limited bandwidth and captured power.

Traditionally, the λ/2 dipole antenna is the most commonly used antenna by the designer as the receiving device for a rectenna due to the straightforward design procedure and the ease of fabrication as a printed circuit antenna. However, the λ/2 dipole has shortcoming as an antenna for an optical detector. A λ/2 dipole antenna only supports a single polarization. It exhibits a relatively low gain, it exhibits very high conductor losses at higher frequencies and its radiation pattern is omni-directional. It has been shown that the rectifier efficiency would be less than 0.1% for the calculated power at the terminal of a rectenna utilizing a λ/2 dipole antenna.

Polarization of solar radiation is known to be random (unpolarized). An unpolarized electromagnetic wave is a collection of waves that have an equal distribution of electric field orientations in all directions. A randomly polarized wave can be decomposed into two main components, $E_x$ and $E_y$. The λ/2 dipole antenna as is commonly known in the art only supports a single polarization and is therefore not useful for the collection of solar radiation or other unpolarized electromagnetic energy.

Accordingly, what is needed in the art is an improved rectenna for the collection of electromagnetic energy and more particularly an improved rectenna for the collection of solar energy that overcomes the identified deficiencies in the prior art solutions.

SUMMARY OF INVENTION

The present invention addresses the problem of receiving an unpolarized wave with a single antenna using two orthogonal feeds. The essence of the invention for intercepting randomly polarized electromagnetic waves is the employment of a dual polarized antenna, which is excited through an aperture by using two well-isolated orthogonal feeds.

The present invention provides for the collection of electromagnetic energy through an antenna element and a non-radiating dielectric waveguide (NRD) having two orthogonal feeds, and the subsequent extraction of energy from the NRD.

In accordance with the present invention, an antenna apparatus for the reception of, and or transmission of, electromagnetic energy is provided. An antenna apparatus for the reception of, and or transmission of, electromagnetic energy, the apparatus including a non-radiating dielectric waveguide, the non-radiating dielectric waveguide further comprising a first conductive plate and a second conductive plate arranged substantially parallel to each other at a predetermined distance, and a dielectric strip element having a length direction positioned between the first conductive plate and the second conductive plate. The non-radiating dielectric waveguide further includes a first aperture fabricated on the first conductive plate and aligned with the dielectric strip element, a second aperture fabricated on the second conductive plate, aligned with the dielectric strip element and positioned at a proximate end of the second conductive plate and a third aperture fabricated on the second conductive plate, aligned with the dielectric strip element and positioned at a distal end of the second conductive plate. An antenna element, such as a dielectric rod antenna, is then aperture coupled to the first aperture. A first transmission line element is electromagnetically coupled to the second aperture and a second transmission line element is electromagnetically coupled to the third aperture, the first transmission line element and the second transmission line element are positioned to be substantially orthogonal with each other.

In another embodiment, a plurality of antenna elements are provided and a plurality of apertures are positioned on the first conductive plate of the dielectric waveguide, each of the plurality of antenna elements aperture is coupled to the non-radiating dielectric waveguide through one of the plurality of apertures.

The transmission line elements of the present invention may be an electromagnetic waveguide, or an optical waveguide, depending upon the particular application. Additionally, the transmission line elements may further include tuning stubs along its length to adjust the impedance of the line.

In an additional embodiment, the antenna apparatus further includes a rectifier, such as a metal-insulator-metal (MIM) diode in circuit communication with the transmission lines to rectify the transmitted energy into a direct current power source.

In a particular embodiment, an antenna apparatus for the conversion of solar energy to direct current power is provided, the apparatus includes a non-radiating dielectric waveguide, the non-radiating dielectric waveguide further comprising a first conductive plate and a second conductive plate arranged substantially parallel to each other at a predetermined distance, and a dielectric strip element having a length direction positioned between the first conductive plate and the second conductive plate. The non-radiating dielectric waveguide further includes a first aperture fabricated on the first conductive plate and aligned with the dielectric strip element, a second aperture fabricated on the second conductive plate, aligned with the dielectric strip element and positioned at a proximate end of the second conductive plate and a third aperture fabricated on the second conductive plate, aligned with the dielectric strip element and positioned at a distal end of the second conductive plate. A dielectric rod antenna is aperture coupled to the first aperture to receive the randomly polarized electromagnetic solar energy and transmit the energy through the non-radiating dielectric waveguide. A first transmission line element is electromagnetically coupled to the second aperture and a second transmission line element is electromagnetically coupled to the third aperture, the first transmission line element and the second transmission line element are positioned to be substantially orthogonal with each other. A rectifier is electrically coupled to the transmission line elements for rectifying the transmitted electromagnetic solar energy into direct current power.

A method for the reception of electromagnetic energy in accordance with the present invention, include the steps of receiving electromagnetic energy through at least one antenna element, transmitting the received electromagnetic energy from the at least one antenna element through a non-radiating dielectric waveguide and transmitting the electromagnetic energy from the non-radiating dielectric waveguide through a pair of transmission line elements that are positioned at opposing ends a the non-radiating dielectric waveguide and are substantially orthogonal to each other. The electromagnetic energy that is transmitted through the transmission lines may then either be detected or rectified as determined by the particular application of the invention. In a specific embodiment, the electromagnetic energy collected by the antenna is solar energy and the method further comprises rectifying the electromagnetic energy transmitted through the transmission line elements to provide direct current power.

BRIEF DESCRIPTION OF THE DRAWINGS

For a fuller understanding of the invention, reference should be made to the following detailed description, taken in connection with the accompanying drawings, in which:

FIG. 2 illustrates the polarization response of an exemplary 7 GHz dual polarized solar antenna in accordance with the present invention, wherein the solid line is the first polarization and the dashed line is the second polarization.

FIG. 3 illustrates the radiation pattern for the first polarization of the exemplary 7 GHz dual polarized solar antenna in accordance with the present invention.

FIG. 4 illustrates the radiation pattern for the second polarization of the exemplary 7 GHz dual polarized solar antenna in accordance with the present invention.

DETAILED DESCRIPTION OF THE PREFERRED EMBODIMENT

The radiation from the sun is randomly polarized, so a single linearly polarized antenna can capture only a fraction of the incident radiation. The present invention proposes the use of cross-polarized linear antenna elements to double the radiation capture and resolve the mismatch between the antenna and solar radiation.

Figure 1:
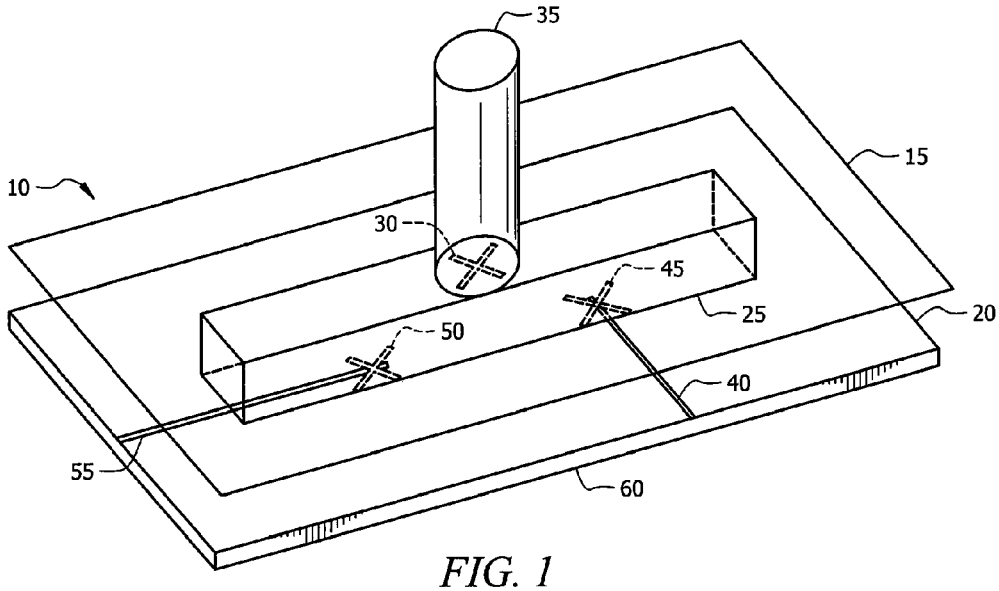
FIG. 1 illustrates an antenna apparatus in accordance with the present invention.

With reference to FIG. 1, the antenna apparatus 10 in accordance with the present invention is illustrated, including a non-radiating dielectric waveguide comprising a first conductive plate 15, having a first aperture 30, and a second conductive plate 20, having a second aperture 45 and a third aperture 50. The two plates are arranged substantially parallel to each other at a predetermined distance, and a dielectric strip element 25 having a length direction is positioned between the first conductive plate 15 and the second conductive plate 20. A first transmission line element 40 is positioned to be electromagnetically coupled to the second aperture 45 and a second transmission line element 55 is positioned to be electromagnetically coupled to the third aperture 50. The first transmission line 45 and the second transmission 55 are positioned at opposite ends of the dielectric strip element 25 and are substantially orthogonal to each other. A dielectric rod antenna 35 is positioned to be aperture coupled with the first aperture 30. The dielectric rod antenna belongs to the family of surface wave antennas. The dielectric rod antenna exhibits high gain and low conductor losses at optical frequencies. However, the invention is not limited to a dielectric rod antenna and other antennas employing aperture coupling feed techniques are within the scope of the present invention.

The non-radiating dielectric waveguide in accordance with the present invention exhibits low loss and is easy to fabricate. The non-radiating dielectric waveguide consists of a section of dielectric slab 25 sandwiched between two ground planes 15, 20. Since the TE modes at the boundary of the dielectric 25 and air are at a maximum, and at the boundary of the dielectric 25 and conductor 15, 20 are at a minimum, the conductor losses are minimized. The transmission losses of the non-radiating dielectric waveguide consist of the dielectric loss and the conductor loss. The dielectric loss is independent of frequency and the conductor loss decreases as the frequency increases. The non-radiating dielectric waveguide is fed through two orthogonal apertures 45, 50 in the bottom ground plane 20 by two orthogonal sections of transmission line 40, 55 on a substrate 60. By changing the position of the transmission lines 40 beneath the aperture 45, or by adding tuning stubs, the broadband matching of the antenna's 35 impedance to a known reference impedance can be facilitated.

Figure 2A:
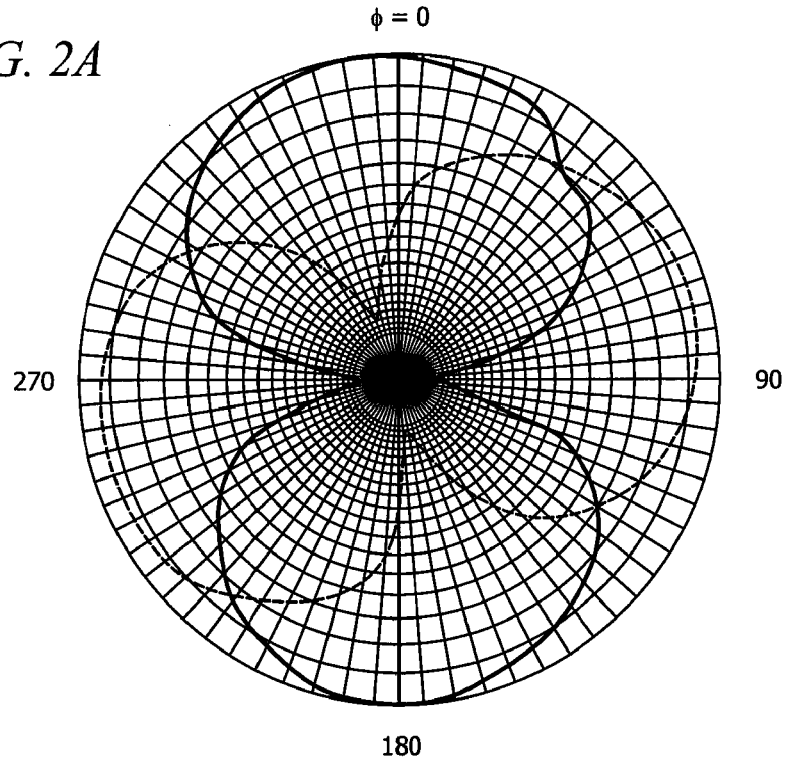
FIG. 2*a* is the measured response and FIG. 2*b* is the simulated response.
Figure 2B:
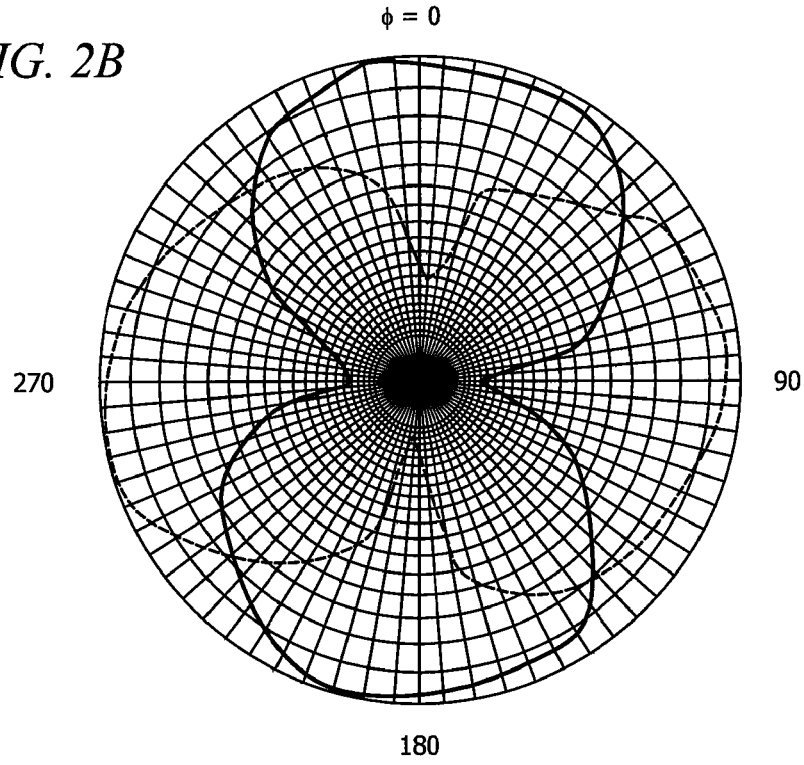
Figure 3A:
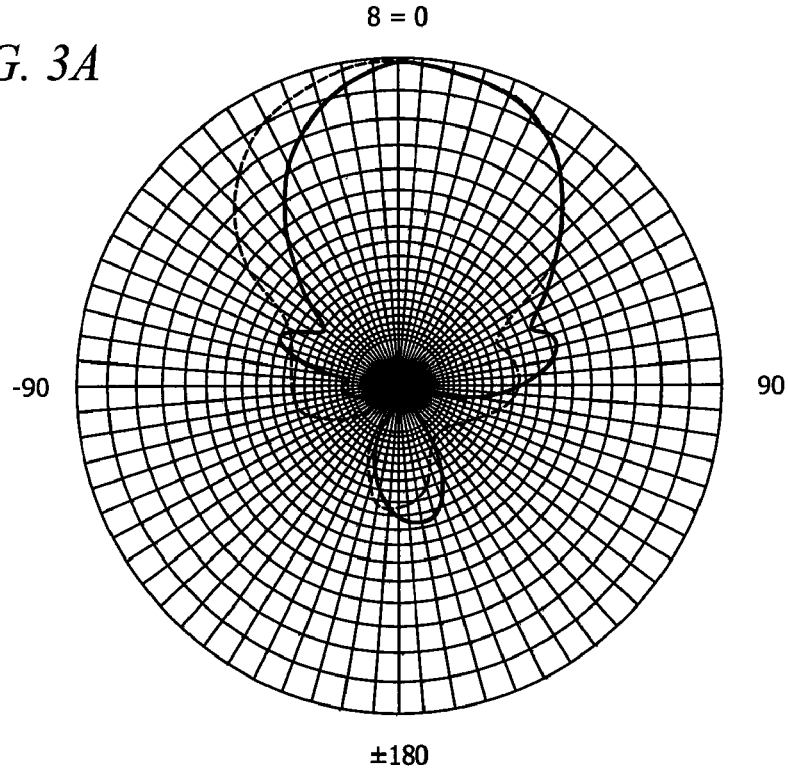
FIG. 3*a* is the E field and FIG. 3*b* is the H field.
Figure 3B:
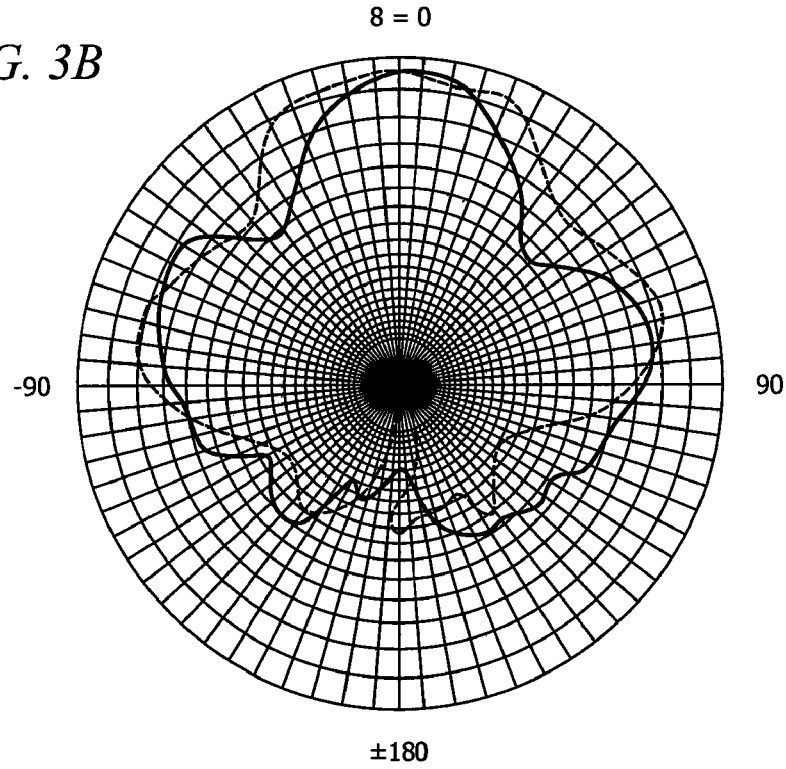
Figure 4A:
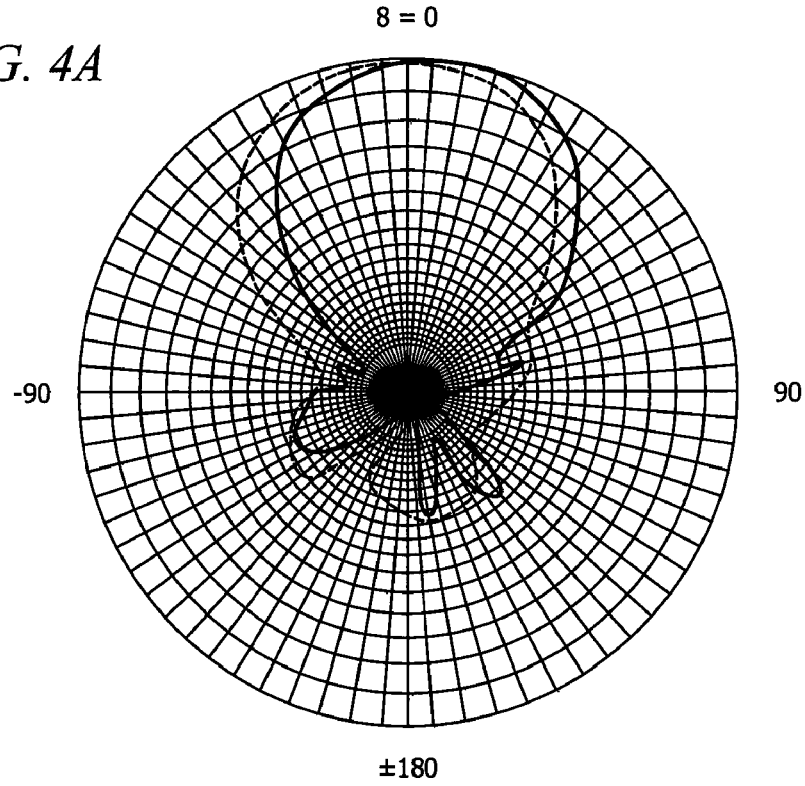
FIG. 4*a* is the E field and FIG. 4*b* is the H field.
Figure 4B:
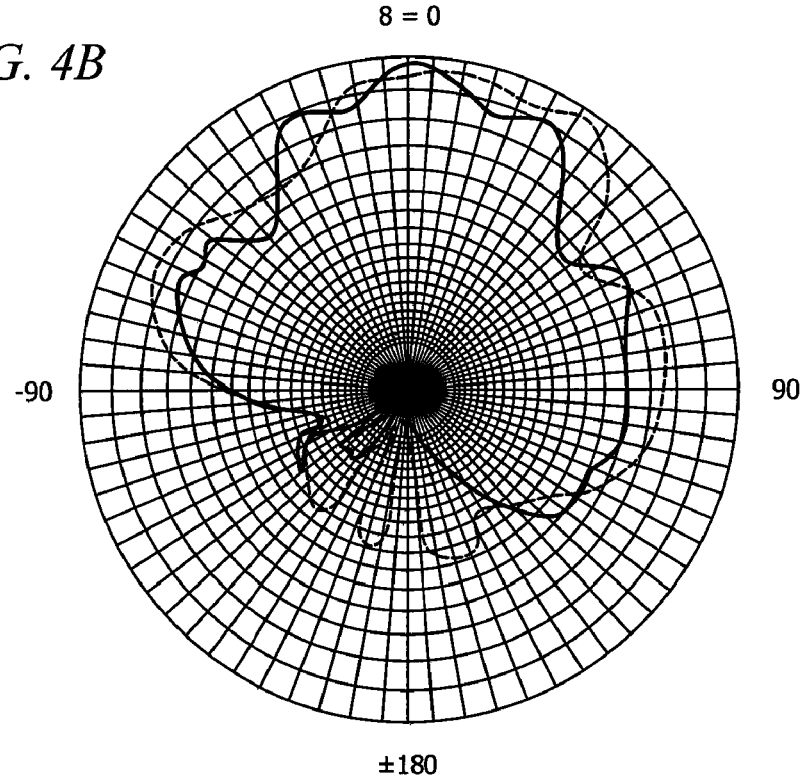

In an exemplary embodiment, the polarization response of a 7 GHz dual polarized solar antenna in accordance with the present invention is illustrated with reference to FIG. 2. In this exemplary embodiment, the dual polarized solar antenna had a power gain of approximately 7 dB. As can be seen, the simulated and measured polarization responses are in good agreement. In FIG. 2, the solid line is the first polarization and the dashed line is the second polarization. FIG. 2*a* is the measured response and FIG. 2*b* is the simulated response. The simulated and measured radiation patterns of both polarizations are also shown in FIG. 3 and FIG. 4. As can be seen, the simulated (dashed) and measured (solid) radiation patterns are in good agreement. In FIG. 3*a*, the E field radiation pattern is shown for the first polarization and in FIG. 3*b*, the H field radiation pattern in shown. In FIG. 4*a*, the E field radiation pattern of the second polarization is shown and in FIG. 4*b*, the H field radiation pattern in shown.

The present invention is not limited to the solar spectrum, but is also viable at much lower frequencies.

As such, the present invention provides an improved antenna array having the ability to intercept randomly polarized electromagnetic waves by employing a single antenna and two orthogonal feeds. While the antenna apparatus has been detailed with respect to its use at optical frequencies to obtain DC power from a high frequency signal received through an antenna, the invention does not require power rectification and may also be employed as an improved detector.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A method for the reception of electromagnetic energy, the method comprising the steps of:

receiving electromagnetic energy through at least one dielectric rod antenna;

transmitting the received electromagnetic energy from the at least one dielectric rod antenna through a non-radiating dielectric waveguide comprising a first conductive plate and a second conductive plate arranged substantially parallel to each other at a predetermined distance and a dielectric strip element having a length direction positioned between the first conductive plate and the second conductive plate, the first conductive plate having a first aperture coupled to the dielectric rod antenna and aligned with the dielectric strip element, the second conductive plate having a second aperture aligned with dielectric strip element and positioned at a proximate end of the second conductive plate and the second conductive plate having a third aperture aligned with the dielectric strip element and positioned at a distal end of the second conductive plate; and transmitting the electromagnetic energy from the non-radiating dielectric waveguide through a first transmission line and a second transmission line element that are positioned at opposing ends of the non-radiating dielectric waveguide and are substantially orthogonal to each other, the first transmission line electromagnetically coupled to the second aperture and the second transmission line electromagnetically coupled to the third aperture.

2. The method of claim 1, further comprising detecting the electromagnetic energy transmitted through the transmission line element.

3. The method of claim 1, further comprising rectifying the electromagnetic energy transmitted through the transmission line element.

4. The method of claim 1, wherein the electromagnetic energy is solar energy and the method further comprises rectifying the electromagnetic energy transmitted through the transmission line element to provide direct current power.

* * * * *